US010289022B2

(12) United States Patent
Akaike et al.

(10) Patent No.: US 10,289,022 B2
(45) Date of Patent: May 14, 2019

(54) DEVELOPING DEVICE AND IMAGE FORMING APPARATUS

(71) Applicant: FUJI XEROX CO., LTD., Tokyo (JP)

(72) Inventors: Takashi Akaike, Kanagawa (JP); Takafumi Wakai, Kanagawa (JP)

(73) Assignee: FUJI XEROX., LTD., Tokyo (JP)

( * ) Notice: Subject to any disclaimer, the term of this patent is extended or adjusted under 35 U.S.C. 154(b) by 0 days.

(21) Appl. No.: 15/943,716

(22) Filed: Apr. 3, 2018

(65) Prior Publication Data

US 2019/0025730 A1 Jan. 24, 2019

(30) Foreign Application Priority Data

Jul. 20, 2017 (JP) ..... 2017-140545

(51) Int. Cl.
*G03G 15/08* (2006.01)
*G03G 21/20* (2006.01)

(52) U.S. Cl.
CPC ..... *G03G 15/0813* (2013.01); *G03G 15/0808* (2013.01); *G03G 15/0822* (2013.01); *G03G 21/206* (2013.01)

(58) Field of Classification Search
CPC ..... G03G 15/0808; G03G 15/0813; G03G 15/0822; G03G 15/0898; G03G 21/206
See application file for complete search history.

(56) References Cited

U.S. PATENT DOCUMENTS 4,100,611 A * 7/1978 Jugle ..... G03G 15/0898 366/139
4,194,465 A * 3/1980 Tsukamoto ..... G03G 15/0898 399/103
6,424,810 B1 * 7/2002 Chappell ..... G03G 15/0898 399/92
2005/0031370 A1 * 2/2005 Koshimura ..... G03G 15/0898 399/99
2007/0098436 A1 * 5/2007 Arakawa ..... G03G 15/0898 399/103
2007/0292164 A1 * 12/2007 Zirilli ..... G03G 15/0822 399/253

(Continued)

FOREIGN PATENT DOCUMENTS

JP 60-049366 A * 3/1985
JP H09-054494 2/1997
JP 2015-079134 4/2015

*Primary Examiner* — Sophia S Chen
(74) *Attorney, Agent, or Firm* — JCIPRNET

(57) ABSTRACT

A developing device includes a developing member that develops an electrostatic latent image on an image carrying member with developer; a housing that houses and supports the developing member and has an open part facing the image carrying member; a storage portion provided inside the housing and storing the developer; and a leakage suppressing member provided at an edge of the open part that is on a downstream side in a direction of rotation of the developing member, the leakage suppressing member suppressing leakage of the developer from the housing toward the image carrying member. The housing has an opening on the downstream side in the direction of rotation with respect to the leakage suppressing member and on an upstream side in the direction of rotation with respect to the storage portion, the opening being open from a side of the developing member toward the outside of the housing.

14 Claims, 4 Drawing Sheets

(56) References Cited

U.S. PATENT DOCUMENTS

| | | | | |
|---|---|---|---|---|
| 2009/0232543 | A1* | 9/2009 | Urasawa | G03G 15/0898 399/113 |
| 2016/0026113 | A1* | 1/2016 | Takahashi | G03G 15/0806 399/285 |
| 2017/0336734 | A1* | 11/2017 | Nagashima | G03G 15/0898 |
| 2018/0081299 | A1* | 3/2018 | Okuno | G03G 15/0898 |

* cited by examiner

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2017-140545 filed Jul. 20, 2017.

BACKGROUND

(i) Technical Field

The present invention relates to a developing device and an image forming apparatus.

(ii) Related Art

When air flows into a developing device with the rotation of a developing member and an image carrying member, the pressure in the developing device rises. Such a pressure difference between the inside and the outside of the developing device, for example, generates an air current flowing toward the outside of the developing device. Such an air current may send toner cloud (toner particles floating in the air) in the developing device to the outside of the developing device.

SUMMARY

According to an aspect of the invention, there is provided a developing device including a developing member that is rotatable while facing an image carrying member and on which a developer layer is formed from above in a vertical direction, the developing member developing an electrostatic latent image on the image carrying member with the developer layer while releasing residual developer downward in the vertical direction; a housing that houses and supports the developing member and has an open part at a position facing the image carrying member; a storage portion provided inside the housing and in which the developer released from the developing member is received; and a leakage suppressing member provided at an edge of the open part that is on a downstream side in a direction of rotation of the developing member, the leakage suppressing member suppressing leakage of the developer from an inside of the housing toward the image carrying member. The housing has an opening at a position on the downstream side in the direction of rotation with respect to the leakage suppressing member and on an upstream side in the direction of rotation with respect to the storage portion, the opening being open from a side of the developing member toward the outside of the housing.

BRIEF DESCRIPTION OF THE DRAWINGS

An exemplary embodiment of the present invention will be described in detail based on the following figures, wherein.

DETAILED DESCRIPTION

Figure 1:
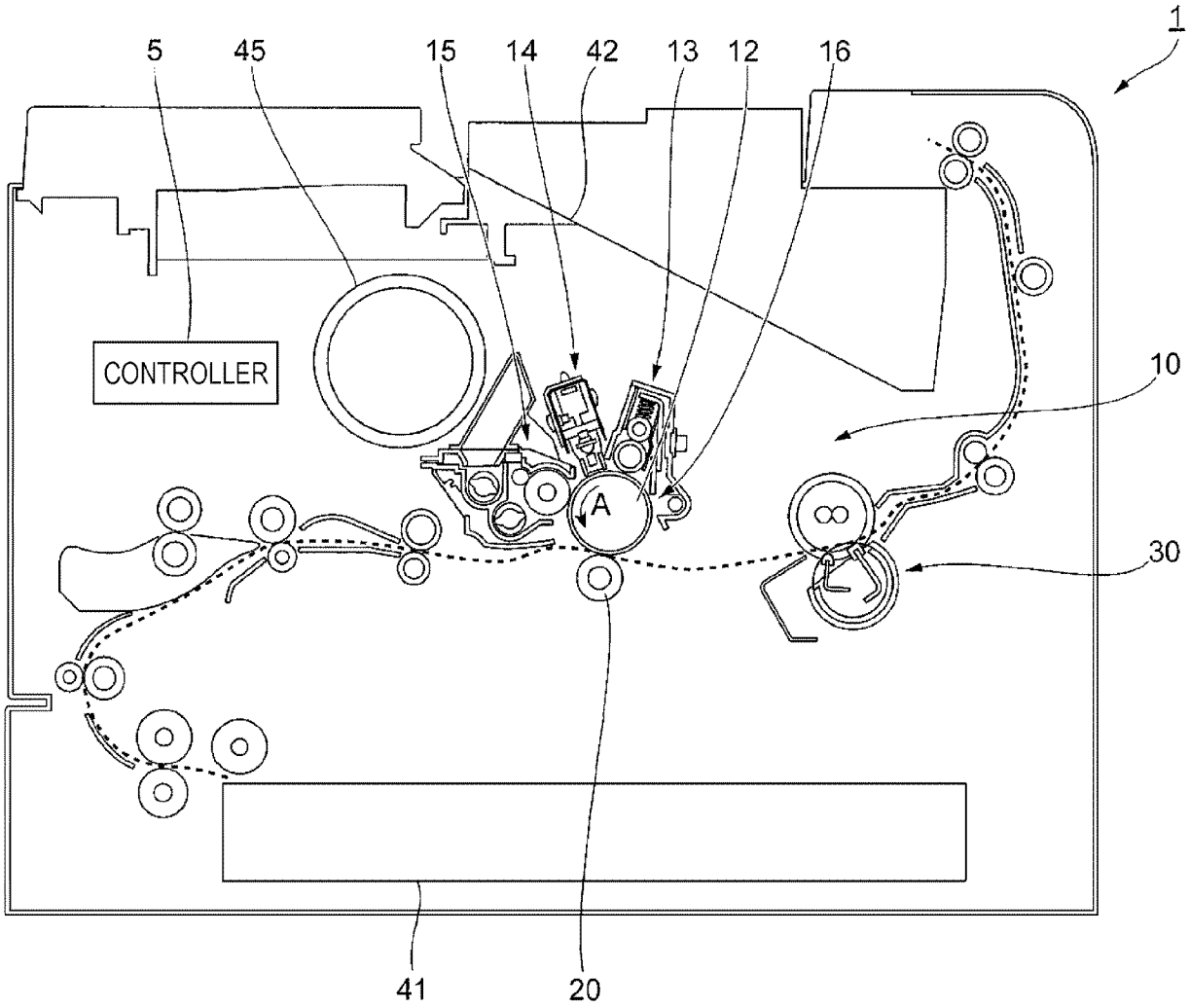
FIG. 1 illustrates an exemplary configuration of an image forming apparatus according to the exemplary embodiment.

FIG. 1 illustrates an exemplary configuration of an image forming apparatus 1 according to an exemplary embodiment. The image forming apparatus 1 is a monochrome printer and includes an image forming unit 10 that forms an image based on image data; and a controller 5 that controls the overall operation of the image forming apparatus 1, communicates with a personal computer (PC) or the like, and executes an image processing operation and so forth in accordance with the image data.

The image forming apparatus 1 further includes a recording-material-supplying unit 41 that supplies a recording material to the image forming unit 10, a recording-material-stacking portion 42 that receives the recording material having an image formed thereon, and a toner cartridge 45 from which toner is supplied to the image forming unit 10.

The image forming unit 10 includes a photoconductor drum 12 as an exemplary image carrying member that is rotatable in the direction of arrow A illustrated in FIG. 1 and that carries a toner image obtained from an electrostatic latent image to be formed thereon. The image forming unit 10 further includes a charging device 13 that charges the surface of the photoconductor drum 12, an exposure device 14 that exposes the photoconductor drum 12 charged by the charging device 13 to light in accordance with the image data, a developing device 15 that develops the electrostatic latent image formed on the photoconductor drum 12 into a toner image, and a cleaner 16 that cleans the surface of the photoconductor drum 12 after a transfer process.

The image forming unit 10 further includes a transfer roller 20 that forms a transfer part in combination with the photoconductor drum 12 and transfers the toner image formed on the photoconductor drum 12 to a recording material, and a fixing device 30 that fixes the toner image on the recording material.

The photoconductor drum 12 includes a cylindrical drum made of thin metal, and an organic photosensitive layer (not illustrated) on the surface of the cylindrical drum.

The charging device 13 includes a charging roller provided in contact with the surface of the photoconductor drum 12. A voltage is applied to the charging roller, whereby the surface of the photoconductor drum 12 is charged to have a predetermined potential.

The exposure device 14 selectively applies light from a device such as a light-emitting diode (LED) or a laser to the photoconductor drum 12 charged by the charging device 13, whereby an electrostatic latent image is formed on the photoconductor drum 12.

The developing device 15 contains, for example, a so-called two-component developer composed of carrier particles having magnetism and toner particles having a predetermined color. The developing device 15 develops the electrostatic latent image on the photoconductor drum 12 with the developer. The developing device 15 according to the present exemplary embodiment is detachably attached to the body of the image forming apparatus 1 and is exchanged for a new one on the basis of factors, such as life and so forth, of relevant components included therein. The configuration of the developing device 15 according to the present exemplary embodiment will be described in detail below.

The cleaner 16 is, for example, a blade and is pressed against the surface of the photoconductor drum 12, thereby scraping post-transfer toner particles adhered to the surface of the photoconductor drum 12 off the surface of the photoconductor drum 12.

In the image forming apparatus 1, the image forming unit 10 performs an image forming operation in accordance with various control signals supplied from the controller 5. Specifically, image data inputted from a PC or the like is processed by the controller 5 and is supplied to the image forming unit 10. In the image forming unit 10, the photoconductor drum 12 rotating in the direction of arrow A is charged by the charging device 13 to have a predetermined potential and is exposed to the light emitted from the exposure device 14 in accordance with the image data transmitted from the controller 5 to the exposure device 14, whereby an electrostatic latent image corresponding to the image data is formed on the photoconductor drum 12. The electrostatic latent image thus formed on the photoconductor drum 12 is developed by the developing device 15 into a toner image having, for example, a black (K) color. Thus, a toner image corresponding to the image data is formed on the photoconductor drum 12.

The toner image thus formed on the photoconductor drum 12 is electrostatically transferred by the transfer roller 20 to a recording material transported to the transfer part.

The recording material having the toner image transferred thereto is then separated from the surface of the photoconductor drum 12 and is transported to the fixing device 30. The toner image on the recording material transported to the fixing device 30 undergoes a fixing process in which heat and pressure are applied to the toner image by the fixing device 30, whereby the toner image is fixed on the recording material. The recording material now having the fixed image is transported to the recording-material-stacking portion 42.

Meanwhile, toner particles adhered to the surface of the photoconductor drum 12 after the transfer process are removed from the surface of the photoconductor drum 12 by the cleaner 16 after the transfer process is finished.

The above image forming process is repeated for the number of pages to be printed.

Figure 2:
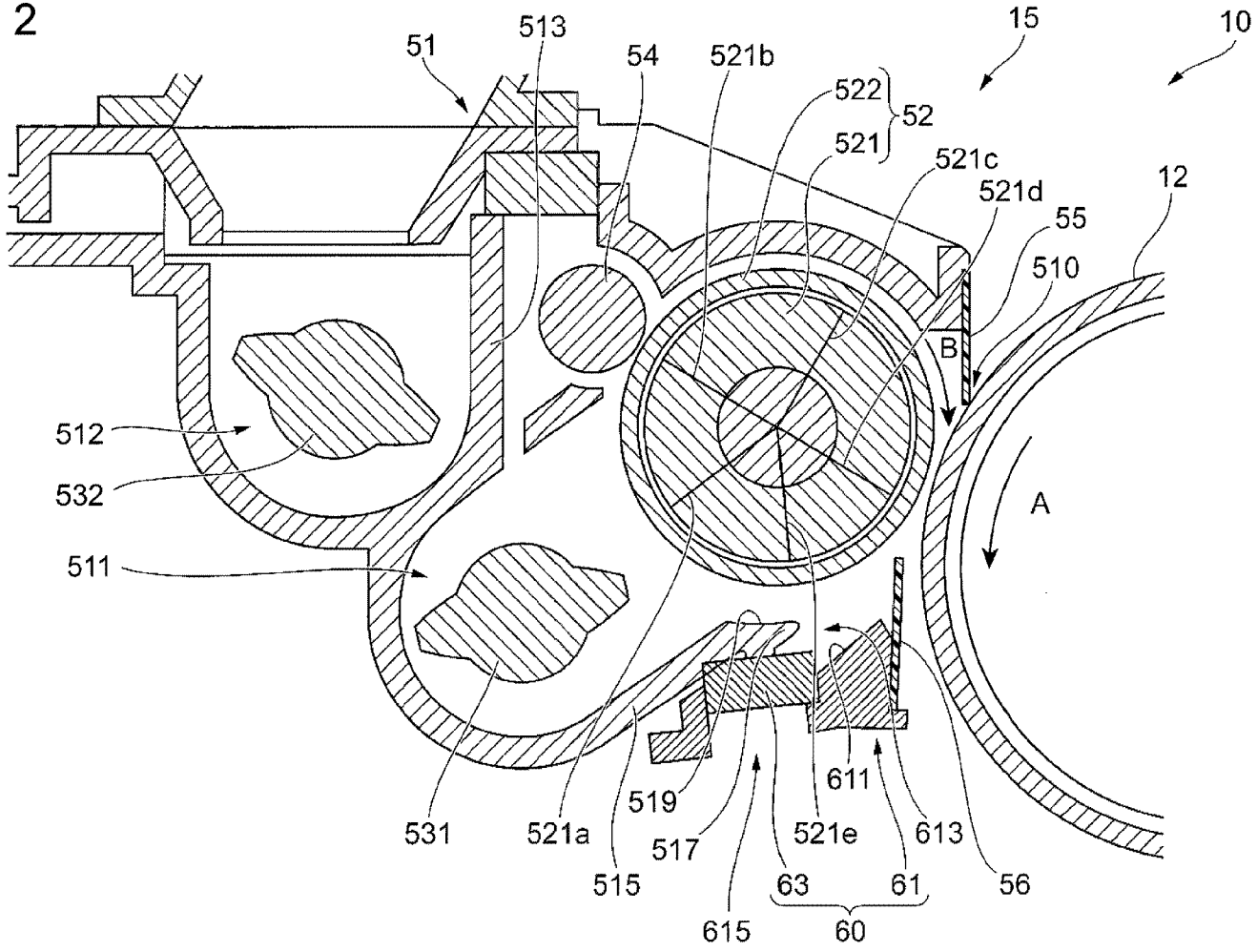
FIG. 2 illustrates a developing device and a photoconductor drum according to the exemplary embodiment.

Now, the configuration of the developing device 15 will be described. FIG. 2 illustrates the developing device 15 and the photoconductor drum 12 according to the present exemplary embodiment.

The developing device 15 according to the present exemplary embodiment includes a development housing 51 in which the developer and relevant components of the developing device 15 are provided. The development housing 51 has an open part 510 at a position facing the outer peripheral surface of the photoconductor drum 12. The developing device 15 further includes a developing roller 52 that faces the photoconductor drum 12 through the open part 510 and that develops the electrostatic latent image on the photoconductor drum 12 with the developer. The developing roller 52 is an exemplary developing member.

The developing device 15 further includes, in the development housing 51, a first stirring member 531 and a second stirring member 532 that are paired for stirring the developer and transporting the developer to the developing roller 52. The first stirring member 531 and the second stirring member 532 each extend in the axial direction of the photoconductor drum 12. The developing device 15 further includes a layer forming member 54 that forms a layer of the developer (a developer layer) on the surface of the developing roller 52 while regulating the thickness of the developer adhered to the surface of the developing roller 52. The developing device 15 further includes a first sealing member 55 and a second sealing member 56 that suppress the leakage of the developer from the development housing 51.

The developing device 15 further includes a collecting mechanism 60 that collects toner cloud generated in the development housing 51 and therearound.

The developing roller 52 is positioned in the development housing 51 in such a manner as to face the photoconductor drum 12 through the open part 510.

The development housing 51 has a first stirring chamber 511 and a second stirring chamber 512, which are each an exemplary storage portion in which the developer is stored. The first stirring chamber 511 and the second stirring chamber 512 extend in the axial direction of the photoconductor drum 12 and are separated from each other by a partition 513. The first stirring chamber 511 is positioned below the developing roller 52 in the vertical direction.

The expression "below the developing roller 52 in the vertical direction" used in the description of the exemplary embodiment describes a situation in which something is positioned below a horizontal plane passing through the axial center of the developing roller 52. Likewise, an expression "above the developing roller 52 in the vertical direction" describes a situation in which something is positioned above the horizontal plane passing through the axial center of the developing roller 52. In either case, the thing does not necessarily overlap the developing roller 52 when seen in the vertical direction.

The development housing 51 further includes an extended portion 515 extending from a lower part of the first stirring chamber 511 toward the developing roller 52 up to a position beyond the top surface of the developer stored in the first stirring chamber 511. The tip of the extended portion 515 is bent (the angle of the extended portion 515 is changed) along the outer peripheral surface of the developing roller 52, whereby a guiding portion 517 is provided. In the present exemplary embodiment, the guiding portion 517 is continuous with the extended portion 515. A guiding surface 519 is provided at the tip of the extended portion 515, i.e., a surface of the guiding portion 517 that faces the outer peripheral surface of the developing roller 52 (a developing sleeve 522 to be described below), with a gap of a predetermined size provided therebetween. In the present exemplary embodiment, the guiding surface 519 faces a part of the outer peripheral surface of the developing roller 52 that is on the lower side in the vertical direction.

In the development housing 51 of the developing device 15, the first stirring member 531 is provided in the first stirring chamber 511, and the second stirring member 532 is provided in the second stirring chamber 512. The first stirring member 531 and the second stirring member 532 cause the developer in the first stirring chamber 511 and the second stirring chamber 512 to circulate and to be transported.

The developing roller 52 includes a magnetic roller 521 and the developing sleeve 522.

The developing sleeve 522 has a cylindrical shape and is rotatable by a driving mechanism (not illustrated) in the direction of arrow B. In the description of the exemplary embodiment, the direction of rotation of the developing roller 52 corresponds to the direction of rotation of the developing sleeve 522. In the present exemplary embodiment, the developing sleeve 522 rotates such that, at a position facing the photoconductor drum 12, the surface thereof moves downward in the vertical direction (in the top-to-bottom direction in FIG. 2). The expression "to move downward in the vertical direction" used herein describes a situation in which the surface of the developing sleeve 522 at the position facing the photoconductor drum 12 moves in a direction containing at least a component oriented downward in the vertical direction.

The developing sleeve 522 is connected to a development power source (not illustrated) that supplies a development bias.

The magnetic roller 521 has a columnar shape and is unrotatably provided inside the developing sleeve 522.

The magnetic roller 521 includes plural magnets. Specifically, the magnetic roller 521 includes, in order of arrangement in the circumferential direction, a pick-up pole 521*a* for picking up the developer from the first stirring chamber 511 of the development housing 51, a layer forming pole 521*b* for forming the developer layer on the outer peripheral surface of the developing sleeve 522 while regulating the thickness of the developer layer in cooperation with the layer forming member 54, a transporting pole 521*c* for transporting the developer layer, a development pole 521*d* for transferring toner particles to the photoconductor drum 12 and developing the electrostatic latent image, and a releasing pole 521*e* for releasing the developer from the developing sleeve 522.

More specifically, the pick-up pole 521*a* faces the first stirring member 531. The layer forming pole 521*b* faces the layer forming member 54. The development pole 521*d* faces the photoconductor drum 12. The releasing pole 521*e* faces the guiding surface 519 of the development housing 51. The transporting pole 521*c* is positioned between the layer forming pole 521*b* and the development pole 521*d* in the circumferential direction of the magnetic roller 521.

From a different point of view, according to the present exemplary embodiment, the layer forming pole 521*b* and the transporting pole 521*c* are positioned in the upper half of the magnetic roller 521 in the vertical direction, while the pick-up pole 521*a*, the development pole 521*d*, and the releasing pole 521*e* are positioned in the lower half of the magnetic roller 521 in the vertical direction.

The layer forming member 54 forms a developer layer having a predetermined thickness on the developing sleeve 522 while regulating the amount of developer that is allowed to pass through the gap between the layer forming member 54 and the developing roller 52 (the developing sleeve 522). The layer forming member 54 and the developing sleeve 522 are positioned such that a gap of a predetermined size is provided between the outer peripheral surfaces thereof over the entire range in the lengthwise direction of the developing sleeve 522 (the axial direction of the developing roller 52).

In the present exemplary embodiment, the layer forming member 54 faces the developing roller 52 (the developing sleeve 522) from above in the vertical direction. In other words, the layer forming member 54 forms a developer layer from the upper side in the vertical direction with respect to the developing roller 52 (the developing sleeve 522).

The first sealing member 55 and the second sealing member 56 suppress the leakage of the developer to the outside of the development housing 51 through the open part 510. the first sealing member 55 and the second sealing member 56 are each made of, for example, flexible resin film or the like.

In the present exemplary embodiment, the first sealing member 55 is attached to the development housing 51 in such a manner as to be in proximity to the outer peripheral surface of the developing roller 52 while being in contact with the outer peripheral surface of the photoconductor drum 12 at a position on the upstream side in the direction of rotation of the developing roller 52 with respect to the position where the developing roller 52 and the photoconductor drum 12 face each other.

The second sealing member 56, which is an exemplary leakage suppressing member, is attached to a holder member 61, to be described below, of the collecting mechanism 60 such that the second sealing member 56 is positioned in proximity to the outer peripheral surfaces of the developing roller 52 and the photoconductor drum 12 at a position on the downstream side in the direction of rotation of the developing roller 52 with respect to the position in the open part 510 where the developing roller 52 and the photoconductor drum 12 face each other. In the present exemplary embodiment, a gap of a predetermined size is provided between the second sealing member 56 and each of the outer peripheral surfaces of the developing roller 52 (the developing sleeve 522) and the photoconductor drum 12.

Now, a developing operation performed by the developing device 15 will be described.

In the developing device 15, the first stirring member 531 and the second stirring member 532 are rotated, and the developer in the development housing 51 is stirred and transported. While the developer is stirred and transported, toner particles and carrier particles contained in the developer rub together, whereby the toner particles are negatively charged, and the carrier particles are positively charged. Consequently, in the developer that is stirred and transported, the toner particles are electrostatically attracted to the carrier particles. When the developer that is stirred and transported reaches the position facing the developing roller 52, some of the carrier particles are transferred to the developing roller 52 with the magnetic force produced between the pick-up pole 521*a* included in the magnetic roller 521 and the carrier particles contained in the developer. The carrier particles thus transferred carry toner particles that are electrostatically attracted thereto. Hence, it is regarded that the developer is transferred to the developing roller 52.

In the developing device 15, the developing sleeve 522 is rotated with the driving force transmitted thereto. Hence, the developer transferred to the developing sleeve 522 is transported with the rotation of the developing sleeve 522. When the developer on the developing sleeve 522 passes through the position where the developing sleeve 522 faces the layer forming member 54, the thickness of the developer is regulated with a magnetic field produced between the developing roller 52 and the layer forming member 54 by the layer forming pole 521*b*. Thus, a developer layer having the regulated thickness is formed on the developing sleeve 522. The developer stopped and removed from the developing sleeve 522 by the layer forming member 54 returns into the first stirring chamber 511 with the gravitational force.

The developer layer thus formed by the layer forming member 54 is transported with the rotation of the developing sleeve 522 and reaches a development area where the photoconductor drum 12 and the developing roller 52 (the developing sleeve 522) face each other. In the developing device 15, a predetermined development bias is applied to the developing sleeve 522. Hence, in the development area, the toner particles are electrostatically transferred from the developer layer on the developing sleeve 522 to the electrostatic latent image on the photoconductor drum 12, whereby the electrostatic latent image is developed and visualized.

The developer remaining on a portion of the developing sleeve 522 that has passed through the development area returns into the development housing 51 with the rotation of the developing sleeve 522. Such residual developer on the developing sleeve 522 returned into the development housing 51 is released from the developing roller 52 by the effect of a repelling magnetic field produced by the releasing pole 521*e* and the pick-up pole 521*a*, which has the same polarity as the releasing pole 521*e*, of the magnetic roller 521 and drops into the first stirring chamber 511. The developer thus dropped is stirred and transported by the first stirring member 531 and the second stirring member 532 again so as to be ready for the next developing process.

In the developing device 15, while the developer is stirred by the first stirring member 531 and the second stirring member 532 or toner particles are supplied to the development housing 51, for example, toner particles may float around in the development housing 51, generating so-called toner cloud. Although details will be described below, the pressure inside the development housing 51 of the developing device 15 is higher than the pressure outside the development housing 51. Therefore, the toner cloud generated in the development housing 51 may leak from the development housing 51.

At the position where the developing roller 52 and the photoconductor drum 12 face each other, when toner particles are transferred from the developer layer formed on the developing roller 52 (the developing sleeve 522) to the photoconductor drum 12, toner particles may float around and generate toner cloud around the photoconductor drum 12.

If such toner cloud adheres to the surface of the photoconductor drum 12, the recording-material transport path, or any other relevant components, the image may be disturbed or the recording material may be stained.

To avoid this, in the developing device 15 according to the present exemplary embodiment, toner cloud is collected by the collecting mechanism 60 so that the adherence of toner cloud to the photoconductor drum 12 and other relevant components is suppressed.

Figure 3A:
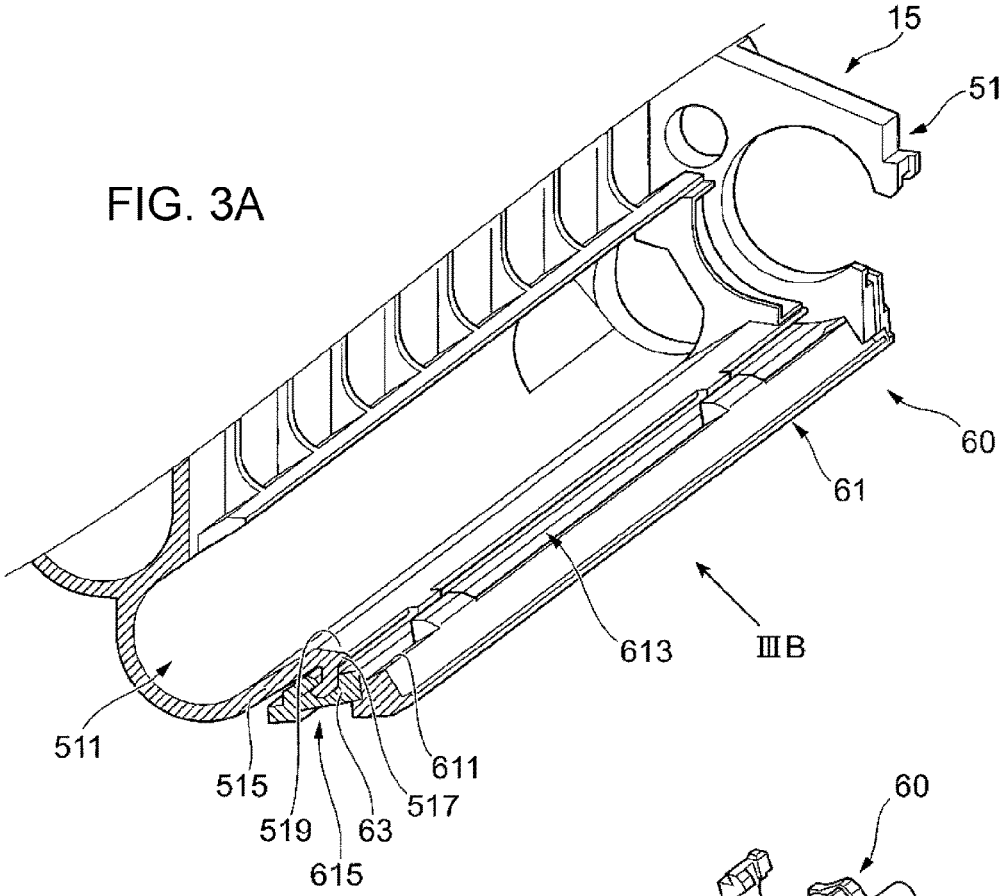
FIGS. 3A and 3B illustrate a configuration of a collecting mechanism according to the exemplary embodiment.
Figure 3B:
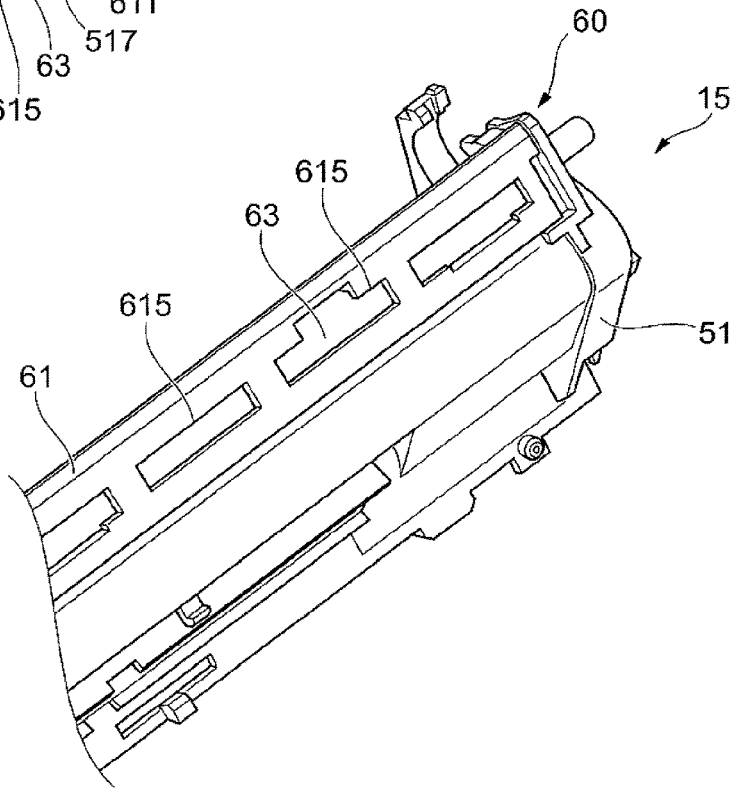

Now, referring to FIG. 2 and FIGS. 3A and 3B, a configuration of the collecting mechanism 60 included in the developing device 15 will be described. FIGS. 3A and 3B illustrate the configuration of the collecting mechanism according to the exemplary embodiment. FIG. 3A illustrates the development housing 51 and the collecting mechanism 60 included in the developing device 15 that are cut along a plane perpendicular to the axial direction of the developing roller 52 (see FIG. 2). FIG. 3B is a view of FIG. 3A seen in the direction of arrow IIIB. In FIGS. 3A and 3B, elements other than the development housing 51 and the collecting mechanism 60 are not illustrated.

The collecting mechanism 60 according to the present exemplary embodiment is an exemplary collecting portion and is provided inside the developing device 15. Specifically, the collecting mechanism 60 is provided on the downstream side in the direction of rotation of the developing roller 52 with respect to the position where the developing roller 52 and the photoconductor drum 12 face each other and the second sealing member 56. The collecting mechanism 60 is provided on the upstream side in the direction of rotation of the developing roller 52 with respect to the extended portion 515 and the first stirring chamber 511 of the development housing 51.

The collecting mechanism 60 is attached to the guiding portion 517 extending from the extended portion 515 of the development housing 51 and includes the holder member 61, which defines a flow path of an air current. The holder member 61 is a component that is formed separately from the extended portion 515 and the guiding portion 517 that are integrally formed. That is, the flow path of the air current is defined by a combination of two components: the extended portion 515 forming a part of the wall of the storage portion (or a component, such as the guiding portion 517, including a portion integrated with the extended portion 515), and a component provided separately from the extended portion 515. The collecting mechanism 60 includes a filter 63 as an exemplary catching member that is held by the holder member 61 and catches toner particles contained in the air current flowing along the holder member 61. In the present exemplary embodiment, the development housing 51 and the holder member 61 form a housing of the developing device 15.

The holder member 61 has a counter surface 611 extending in the axial direction of the developing roller 52 and that faces the guiding portion 517 of the development housing 51 with a gap of a predetermined size provided therebetween. A flow path 613 along which the air current leaking from the development housing 51 or the like flows is defined between the counter surface 611 and the guiding portion 517 of the development housing 51. In the present exemplary embodiment, the flow path 613 defined by the holder member 61 faces the outer peripheral surface of the developing roller 52. As the distance from the outer peripheral surface of the developing roller 52 increases, the inclination of the flow path 613 with respect to the vertical direction increases (the flow path 613 inclines from the upper right toward the lower left in FIG. 2). In other words, the flow path 613 extends in a direction away from the open part 510 and from a portion of the photoconductor drum 12 that is positioned at the open part 510. Specifically, a surface of the guiding portion 517 that defines the flow path 613 is not perpendicular to the guiding surface 519 and inclines in a direction away from the open part 510 and the photoconductor drum 12 as the distance from the outer peripheral surface of the developing roller 52 increases. The counter surface 611 of the holder member 61 that defines the flow path 613 also inclines in the same direction.

The holder member 61 includes plural outlets 615 that are each continuous with the flow path 613 and from which air flowing from the flow path 613 is discharged to the outside of the developing device 15. The plural outlets 615 are arranged side by side in the axial direction of the developing roller 52. Each of the outlets 615 has one end connected to the flow path 613 and the other end connected to the outside of the developing device 15.

In the present exemplary embodiment, the flow path 613 defined by the holder member 61 and the outlets 615 provide openings each extending from the side of the developing roller 52 toward the outside of the developing device 15.

The filter 63 is a member made of, for example, nonwoven fabric or the like and is capable of catching toner particles while allowing air to pass therethrough. The filter 63 extends in the axial direction of the developing roller 52 and is held by the holder member 61 in such a manner as to close the connections between the flow path 613, defined by the holder member 61, and the plural outlets 615. Thus, the filter 63 catches toner particles contained in the air flowing from the flow path 613 toward the outlets 615. The method by which the filter 63 is held by the holder member 61 is not specifically limited. The filter 63 may be fixed to the holder member 61 with double-sided adhesive tape or the like. Alternatively, hooks or the like for fixing the filter 63 may be formed on the holder member 61.

Figure 4:
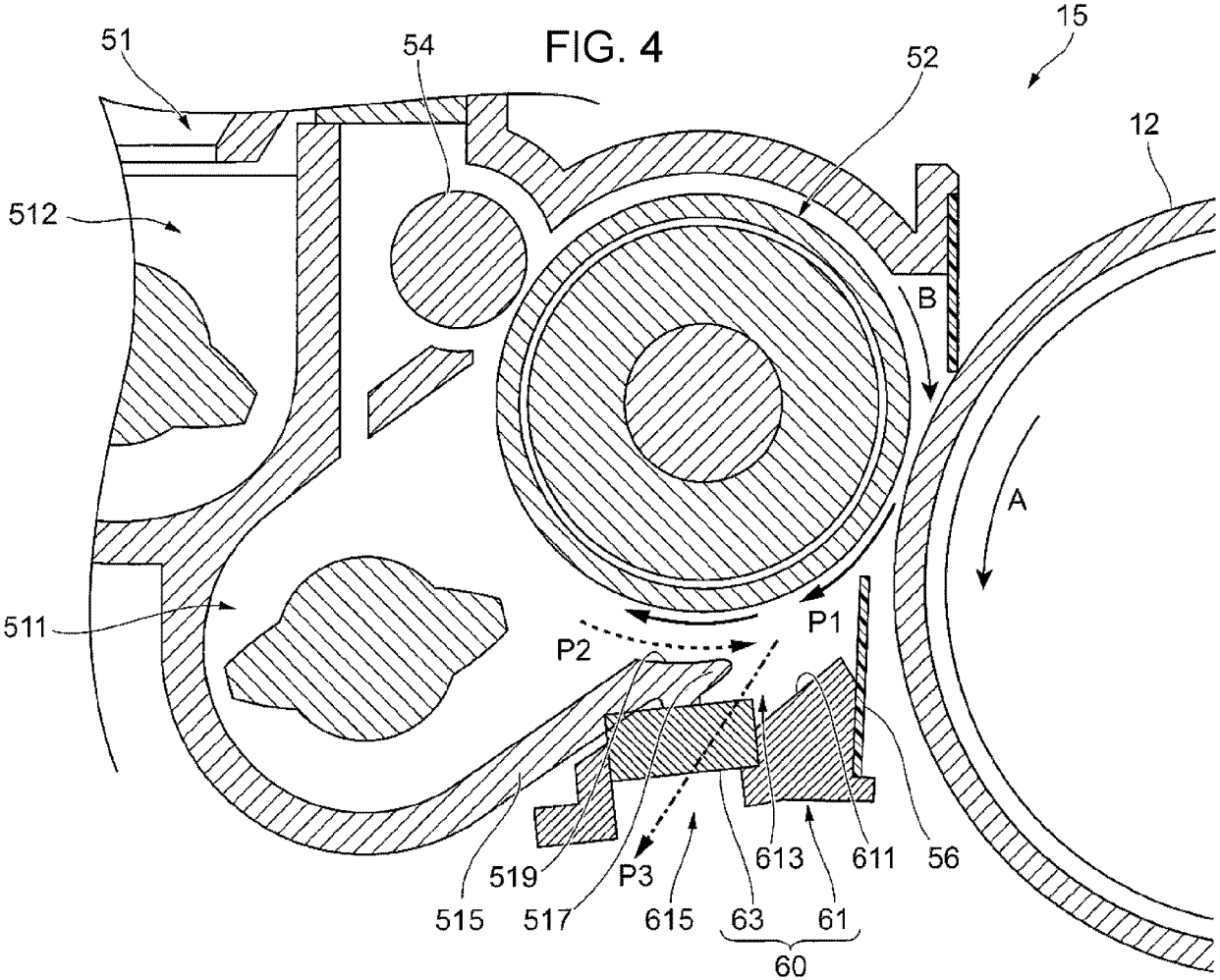
FIG. 4 illustrates the flow of air currents generated around the developing device and the photoconductor drum according to the exemplary embodiment.

Now, the flow of air currents containing toner cloud generated around the developing device 15 and the photoconductor drum 12 and the collection of toner cloud by the collecting mechanism 60 will be described. FIG. 4 illustrates the flow of air currents generated around the developing device 15 and the photoconductor drum 12 according to the present exemplary embodiment.

As described above, when the image forming unit 10 (see FIG. 1) forms an image, the photoconductor drum 12 is rotated in the direction of arrow A while the developing roller 52 (the developing sleeve 522) is rotated in the direction of arrow B (see FIG. 2). In response to this, an air current represented by arrow P1 is generated along the outer peripheral surface of the developing roller 52 and in the direction of rotation of the developing roller 52. The air current P1 thus generated with the rotation of the developing roller 52 flows through the gap between the guiding surface 519 of the development housing 51 and the developing roller 52, as illustrated in FIG. 4, and flows into the first stirring chamber 511.

Thus, air as the air current P1 flows from the outside of the developing device 15 into the first stirring chamber 511 of the development housing 51. When the air flows into the first stirring chamber 511 from the outside of the developing device 15, the pressure inside the development housing 51 rises and becomes higher than the pressure outside the developing device 15.

When the pressure inside the development housing 51 rises, an air current flowing from the inside of the first stirring chamber 511 toward the outside of the developing device 15 is generated with the pressure difference between the inside and the outside of the development housing 51. Specifically, as represented by arrows P2 and P3 in FIG. 4, an air current is generated in such a manner as to flow from the inside of the first stirring chamber 511 along the outer peripheral surface of the developing roller 52 and the guiding surface 519 in a direction opposite to the direction of rotation of the developing roller 52 and to flow through the collecting mechanism 60 to the outside of the developing device 15.

As described above, toner cloud may be generated inside the development housing 51 and the position where the developing roller 52 and the photoconductor drum 12 face each other. In the developing device 15 according to the present exemplary embodiment, air containing toner cloud generated in the development housing 51 is guided by the air current P2 and the air current P3 and thus reaches the collecting mechanism 60. More specifically, in the developing device 15 according to the present exemplary embodiment, air containing toner cloud reaches the collecting mechanism 60 before reaching the surface of the photoconductor drum 12.

Likewise, air containing toner cloud generated at the position where the developing roller 52 and the photoconductor drum 12 face each other is guided by the air current P1 and the air current P3 and thus reaches the collecting mechanism 60.

The air having reached the collecting mechanism 60 flows along the flow path 613, passes through the filter 63, and is discharged from the outlets 615 to the outside of the developing device 15. More specifically, when the air passes through the filter 63, the toner cloud contained in the air is caught by the filter 63. Therefore, air from which the toner cloud has been removed is discharged from the outlets 615.

To summarize, in the developing device 15 according to the present exemplary embodiment, air containing toner cloud generated in the development housing 51 and at the position where the developing roller 52 and the photoconductor drum 12 face each other is guided in a direction away from the surface of the photoconductor drum 12 by the collecting mechanism 60 provided in the developing device 15. Hence, the adhesion of the toner cloud to the surface of the photoconductor drum 12 is suppressed, and the image disturbance and staining of the recording material are suppressed.

In the developing device 15 according to the present exemplary embodiment, the toner cloud contained in the air current guided by the collecting mechanism 60 is caught by the filter 63, and the resulting air, which no longer contains the toner cloud, is discharged from the outlets 615. Hence, staining of the inside of the image forming apparatus and therearound with the air discharged from the collecting mechanism 60 is less likely to occur than in a case where such toner cloud is not caught by the filter 63.

In the present exemplary embodiment, the collecting mechanism 60 is provided inside the developing device 15 that is detachably attached to the body of the image forming apparatus 1. Hence, the collecting mechanism 60 is exchangeable for a new one when, for example, the developing device 15 is exchanged for a new one. That is, each of relevant components such as the filter 63 itself does not need to be exchanged. Hence, in the image forming apparatus 1, the number of components to be exchanged and the steps to be performed in the exchanging work are reduced.

In the collecting mechanism 60 according to the present exemplary embodiment, the filter 63 is provided at a position of the holder member 61 where the flow path 613 is connected to the outlets 615, as described above. Hence, developer released from the developing roller 52 or spilled from the first stirring chamber 511 is less likely to adhere to the filter 63 than in a case where, for example, the filter 63 is provided at a position of the flow path 613 that faces the developing roller 52. Consequently, the occurrence of developer-attributed clogging of the filter 63 and other like troubles is suppressed, and the reduction in the life of the filter 63 is suppressed.

In the collecting mechanism 60 according to the present exemplary embodiment, the filter 63 that allows air to pass therethrough is employed as a unit for catching the toner cloud contained in the air guided to the collecting mechanism 60. The present invention is not limited to such an embodiment. For example, the holder member 61 may have plural projections projecting toward the flow path 613 so that toner could is made to adhere to the projections when the air flows through the flow path 613.

In the present exemplary embodiment, the collecting mechanism 60 includes the holder member 61 that is separate from the extended portion 515 and the guiding portion 517. Alternatively, a mechanism that collects toner cloud generated in the development housing 51 or the like may be provided to the extended portion 515 or the guiding portion 517 itself. For example, through holes may be provided in the guiding portion 517, and the toner cloud generated in the development housing 51 or the like may be taken into the through holes.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developing member that is rotatable while facing an image carrying member and on which a developer layer is formed from above in a vertical direction, the developing member developing an electrostatic latent image on the image carrying member with the developer layer while releasing residual developer downward in the vertical direction;

a housing that houses and supports the developing member and has an open part at a position facing the image carrying member;

a storage portion provided inside the housing and in which the developer released from the developing member is received; and a leakage suppressing member provided at an edge of the open part that is on a downstream side in a direction of rotation of the developing member, the leakage suppressing member suppressing leakage of the developer from an inside of the housing toward the image carrying member, wherein the housing has an opening at a position on a downstream side in the direction of rotation with respect to the leakage suppressing member and on an upstream side in the direction of rotation with respect to the storage portion, the opening being open from a side of the developing member toward an outside of the housing, the developing device further comprises a catching member that catches toner particles contained in air that passes through the opening, wherein the catching member is a member through which air is allowed to flow, the catching member being provided in such a manner as to cover the opening.

2. The developing device according to claim 1, wherein the opening provides a flow path extending from the side of the developing member toward the outside of the housing and in a direction away from the open part.

3. The developing device according to claim 2, wherein the opening provides a flow path extending from the side of the developing member toward the outside of the housing, and wherein the catching member is attached to a position further to the outside of the housing with respect to an end of the flow path that is on the side of the developing member.

4. The developing device according to claim 1, wherein the opening provides a flow path extending from the side of the developing member toward the outside of the housing, and wherein the catching member is attached to a position further to the outside of the housing with respect to an end of the flow path that is on the side of the developing member.

5. The developing device according to claim 1, wherein the housing includes an extended portion provided on the upstream side in the direction of rotation with respect to the storage portion and extends from vertically below the storage portion toward an outer peripheral surface of the developing member, and wherein the opening is provided on an upstream side in the direction of rotation with respect to a tip of the extended portion, the tip being a part of the extended portion that is closest to the outer peripheral surface of the developing member.

6. The developing device according to claim 5, wherein the housing further includes a guiding portion provided at the tip of the extended portion, the guiding portion being bent along the outer peripheral surface of the developing member and extending toward the upstream side in the direction of rotation, and wherein the opening is provided in the guiding portion.

7. The developing device according to claim 6, wherein the opening is provided on an upstream side in the direction of rotation with respect to a releasing pole that causes the developer to be released from the developing member.

8. The developing device according to claim 5, wherein the opening is provided on an upstream side in the direction of rotation with respect to a releasing pole that causes the developer to be released from the developing member.

9. A developing device comprising:

a developing member that faces an image carrying member and rotates in such a manner as to move downward in a vertical direction at a position facing the image carrying member, the developing member developing an electrostatic latent image on the image carrying member;

a storage portion provided on a downstream side in a direction of rotation of the developing member with respect to the image carrying member and in which developer is stored;

a guiding portion provided in proximity to the developing member at a position on an upstream side in the direction of rotation with respect to the storage portion and that guides an air current generated with the rotation of the developing member to the storage portion; and a collecting portion that collects an air current discharged from the storage portion and flowing along the guiding portion with a pressure difference between an inside and an outside of the storage portion, the air current discharged from the storage portion being collected before reaching the image carrying member.

10. The developing device according to claim 9, wherein the collecting portion further collects an air current generated with the rotation of the developing member and at a position where the developing member and the image carrying member face each other.

11. The developing device according to claim 9, wherein the collecting portion discharges the collected air current in a direction away from the image carrying member after removing toner particles contained in the collected air current.

12. The developing device according to claim 9, wherein the housing includes an extended portion provided on the upstream side in the direction of rotation with respect to the storage portion and extends from vertically below the storage portion toward an outer peripheral surface of the developing member, and wherein the opening is provided on an upstream side in the direction of rotation with respect to a tip of the extended portion, the tip being a part of the extended portion that is closest to the outer peripheral surface of the developing member.

13. The developing device according to claim 12, wherein the opening is provided on an upstream side in the direction of rotation with respect to a releasing pole that causes the developer to be released from the developing member.

14. A developing device comprising:

a developing member that is rotatable while facing an image carrying member and on which a developer layer is formed from above in a vertical direction, the developing member developing an electrostatic latent image on the image carrying member with the developer layer while releasing residual developer downward in the vertical direction;

a housing that houses and supports the developing member and has an open part at a position facing the image carrying member;

a storage portion provided inside the housing and in which the developer released from the developing member is received; and a leakage suppressing member provided at an edge of the open part that is on a downstream side in a direction of rotation of the developing member, the leakage suppressing member suppressing leakage of the developer from an inside of the housing toward the image carrying member, wherein the housing has an opening at a position on a downstream side in the direction of rotation with respect to the leakage suppressing member and on an upstream side in the direction of rotation with respect to the storage portion, the opening being open from a side of the developing member toward an outside of the housing, wherein the housing includes an extended portion provided on the upstream side in the direction of rotation with respect to the storage portion and extends from vertically below the storage portion toward an outer peripheral surface of the developing member, the opening is provided on an upstream side in the direction of rotation with respect to a tip of the extended portion, the tip being a part of the extended portion that is closest to the outer peripheral surface of the developing member, and wherein the housing further includes a guiding portion provided at the tip of the extended portion, the guiding portion being bent along the outer peripheral surface of the developing member and extending toward the upstream side in the direction of rotation, and the opening is provided in the guiding portion.

* * * * *